United States Patent [19]

Brigham

[11] Patent Number: 4,662,181

[45] Date of Patent: May 5, 1987

[54] METHOD AND APPARATUS FOR EXTENDING THE DURATION OF OPERATION OF A CRYOGENIC PUMPING SYSTEM

[75] Inventor: William D. Brigham, Huntington Beach, Calif.

[73] Assignee: Zwich Energy Research Organization, Inc., Huntington Beach, Calif.

[21] Appl. No.: 685,380

[22] Filed: Dec. 24, 1984

[51] Int. Cl.[4] ..... F17C 7/02

[52] U.S. Cl. ..... 62/55; 417/300; 417/309

[58] Field of Search ..... 62/53, 55; 417/300, 417/309

[56] References Cited

U.S. PATENT DOCUMENTS

| | | | |
|---|---|---|---|
| 2,644,400 | 7/1953 | Hofer | 417/309 |
| 3,286,636 | 11/1966 | Schaub | 417/300 |
| 3,633,372 | 1/1972 | Kimmel et al. | 62/55 |
| 3,912,419 | 10/1975 | Lutz et al. | 417/300 |
| 4,197,712 | 4/1980 | Zwick et al. | 62/53 |
| 4,276,749 | 7/1981 | Crowley | 62/55 |
| 4,412,851 | 11/1983 | Laine | 62/55 |

FOREIGN PATENT DOCUMENTS 148082 9/1982 Japan .

*Primary Examiner*—Ronald C. Capossela

*Attorney, Agent, or Firm*—Beehler, Pavitt, Siegemund, Jagger, Martella & Dawes

[57] ABSTRACT

The duration of a pumping operation from a fixed supply of cryogenic liquid is extended by minimizing the amount of cryogenic liquid which is recirculated between a primary cryogenic pump and a storage tank for containing the cryogenic liquid. The primary cryogenic pump is characterized by a minimum necessary net positive suction head at its intake. The net positive suction head of the cryogenic liquid is directly measured at the inlet of the primary cryogenic pump by means of a differential pressure gauge. The total pressure on the cryogenic liquid at the inlet of the primary cryogenic pump is then maintained by means of a cryogenic booster pump to always exceed the measured vapor pressure at the inlet by an amount just equal to the minimum net positive suction head required by the primary cryogenic pump. Therefore, the minimum amount of pressure necessary to allow the primary cryogenic pump to operate is supplied to its inlet and thereby the amount of cryogenic liquid which is circulated from the storage tank to the primary cryogenic pump and then recirculated to the storage tank by means of a return line is minimized. Thus, the amount of energy absorbed by the recirculated cryogenic liquid is similarly minimized and the duration of the pumping operation is extended.

20 Claims, 2 Drawing Figures

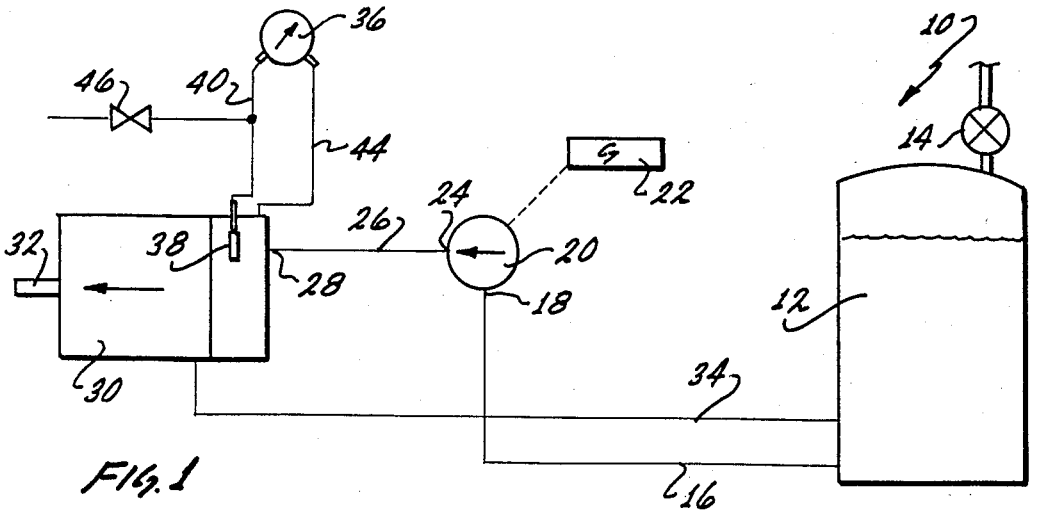
FIG. 1
FIG. 2
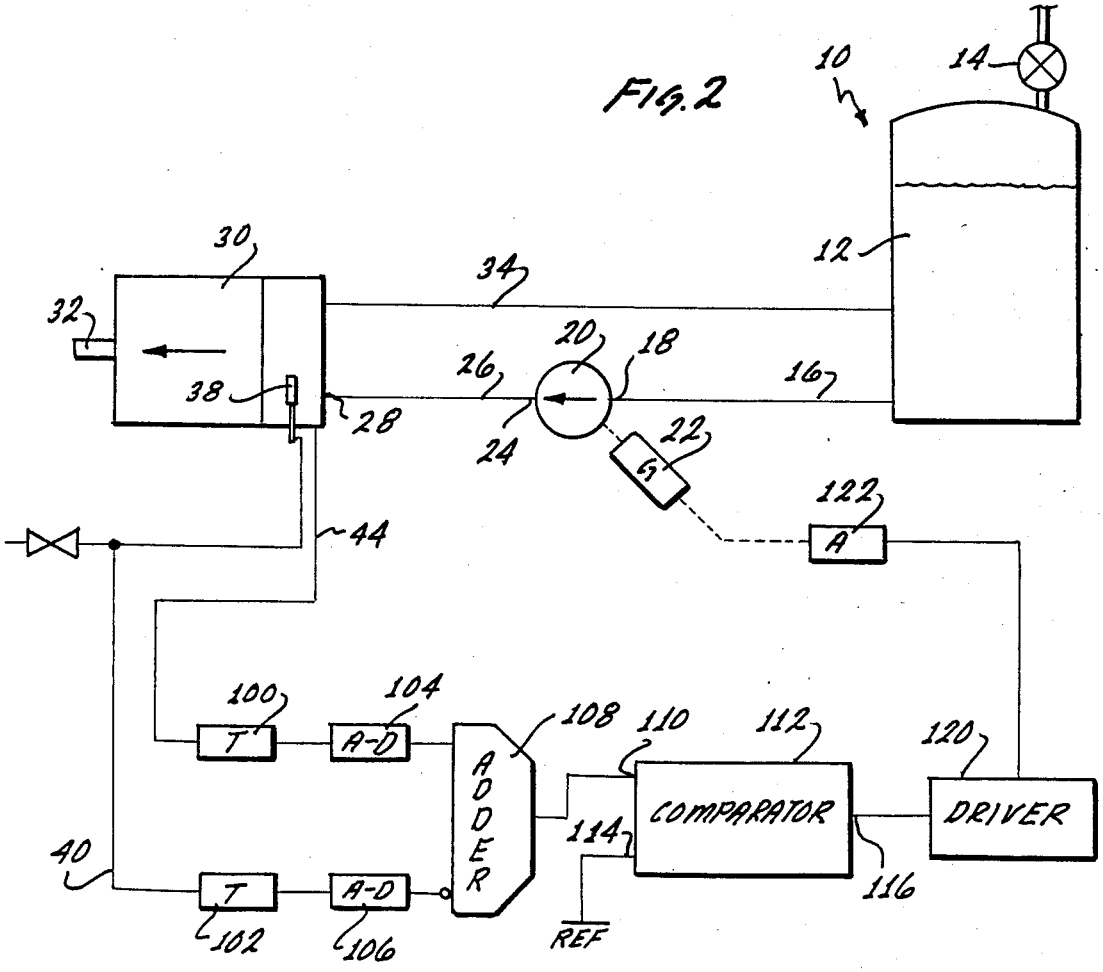

METHOD AND APPARATUS FOR EXTENDING THE DURATION OF OPERATION OF A CRYOGENIC PUMPING SYSTEM

BACKGROUND OF THE INVENTION

1. Field of the Invention

The present invention relates to the field of cryogenic pumping and in particular to a method and apparatus for improving the duration of operation of a cryogenic pumping system.

2. Description of the Prior Art

Cryogenic fluid, such as liquid nitrogen, is used in many industrial applications of which one includes oil well servicing. Liquid nitrogen is delivered to a well site storage tank, pumped from the storage tank, vaporized, and injected under pressure into the well bore to facilitate various drilling and oil recovery operations. One such apparatus for conversion of liquid nitrogen to gaseous nitrogen for high pressure delivery at a well head is shown and described in Zwick et al, "Fluid Pumping and Heating System," U.S. Pat. No. 4,197,712.

Typically in cryogenic delivery systems, the cryogenic fluid is drawn from a cryogenic storage tank by means of a triplex reciprocating pump. In order to effectively operate, the pump must have a net positive suction head at its inlet. In other words, given the vapor pressure of the cryogenic fluid at inlet of the pump, the net positive pressure on the cryogenic fluid must be large enough to prevent cavitation of the cyrogenic fluid during the intake stroke or cycle of the pump. Should the fluid cavitate, the pump will be ineffective to transfer the cryogenic liquid from the storage tank. In fact, such pumps require a positive input pressure which exceeds the vapor pressure of the cryogenic liquid by a predetermined magnitude. Typically 25 psi of net positive suction head is required in order for such pumps to operate or operate with any practical efficiency.

In order to partially overcome these difficulties, the prior art solution is to insert a centrifugal booster pump between the cryogenic liquid storage tank and the input of the triplex reciprocating pump. The net positive suction head required at the input of a centrifugal pump is substantially less than that required by a triplex reciprocating pumps, normally being of the order of 5 psi. The output of the centrifugal pump is then adjusted to a level to insure continued operation of the main reciprocating pump, namely typically within the range of 50 to 60 psi. Thus by supplying the lower net positive suction head at the input of the centrifugal pump, continued operation of the main triplex reciprocating pump can be insured for a longer period of time.

However, even with the centrifugal booster pump which serves as a priming pump for the main triplex pump, operation of such a cryogenic pumping circuit is limited and will eventually cease to operate. Cryogenic pumping is eventually stopped by rise in the vapor pressure of the cryogenic fluid which is delivered to the input of the triplex pump. This situation arises as follows. Generally, the pumping capacity of the main reciprocating pump is of the order of approximately 15 gallons per minute of liquid cryogenic fluid. However, at a 50 to 60 psi total pressure head applied to the input of the reciprocating pump from the output of the centrifugal booster pump, much more than 15 gallons per minute of cryogenic fluid can be supplied to the inlet of the triplex pump. If cryogenic fluid is left in a standing or near standing state, it tends to pick up heat from the ambient environment through the coils, tubing and pumps of the equipment and thus flash into a gaseous state. When this occurs further pumping of the liquid cryogenic fluid becomes difficult or impossible. Therefore, it is necessary to maintain the flow of the cryogenic fluid even when it exceeds the user's need or the current throughput volume through the triplex pump. As a result, a return line is provided from the triplex pump back to the cryogenic storage tank. A portion of the cryogenic fluid is thus recirculated between the storage tank and triplex pump. As this fluid is recirculated, it will absorb heat from the ambient environment. Slowly the temperature within the cryogenic liquid will increase due to unavoidable energy absorption during recirculation, and the vapor pressure of the cryogenic liquid will rise. Ultimately the vapor pressure will rise within the cryogenic storage tank to the point where even the minimum net positive suction head at the input of the centrifugal booster pump cannot be supplied. At this point the input to the centrifugal pump will begin to cavitate and pumping of liquid cryogenic fluid will cease. As a result the duration of operation of cryogenic pumping systems is limited.

In the application of oil well servicing, typically operation times are of the order of approximately two hours. Somewhat less commonly, oil well servicing systems will operate at their minimum capacity which extends their operational period to approximately 40 hours. Therefore prior art systems have been built with cryogenic storage tanks capable only of holding only that amount of cryogenic liquid which can be pumped during the generally expected operating times of the cryogenic system before cavitation occurs at the input to the booster pump. As stated, this has generally been a duration of approximately 2 to 40 hours. When pumping ceases, the cryogenic liquid has been exhausted from the storage tank or nearly exhausted. The remaining pressure in the storage tank is then dumped and if operations are to continue, the cryogenic storage tank must be repressurized to vent the vapor pressure, and allow boil off from the liquid to re-establish the initial or appropriate temperature of any remaining cyrogenic liquid. This necessarily entails a material loss of cryogenic liquid and a substantial downtime before pumping can resume.

What is needed then is some method and apparatus whereby the pumping duration of cryogenic systems can be extended without being subject to the shortcomings of the prior art as described above.

BRIEF SUMMARY OF THE INVENTION

The invention includes a method of pumping cryogenic liquid comprising the steps of applying a first pressure to cryogenic liquid supplied to the inlet of a cryogenic pump; measuring the vapor pressure of the cryogenic liquid at the inlet to the cryogenic pump; measuring total pressure of the cryogenic liquid at the inlet of the pump; subtracting the vapor pressure from the total pressure to obtain a measured net positive suction head at the inlet of the pump; adjusting the first pressure until the measured net positive suction head at least equals a predetermined magnitude corresponding to a predetermined minimum net pressure suction head characteristic of the pump; and returning excess cryogenic liquid from the inlet of the cryogenic pump to the storage tank. By reason of this combination of steps the duration of operation of the cryogenic pump is extended.

The step of measuring the vapor pressure comprises the step of directly sensing the vapor pressure of the cryogenic liquid provided to the inlet of the cryogenic pump.

The step of directly sensing the vapor pressure comprises the step of precharging a pressure vessel with a gas. The pressure vessel is in thermal communication with the cryogenic fluid supplied to the inlet of the cryogenic pump. The gas disposed into the pressure vessel is allowed to reach thermal equilibrium with the cryogenic liquid provided to the inlet of the cryogenic pump. The vapor pressure of the gas in the pressure vessel, after equilibrium is substantially achieved, is then measured by means of a differential pressure gauge. The opposing inlet of the differential pressure gauge measures the total pressure of the cryogenic liquid. The differential pressure gauge balances the two inputs to directly measure the net positive suction head.

Alternatively the invention can be summarized as a method of pumping cryogenic liquid from a storage tank to a primary cryogenic pump wherein the storage tank and cryogenic pump are coupled through a supply line and a return line for returning excess cryogenic liquid supplied to the pump to the storage tank. The method comprises the steps of precharging a pressure vessel with a fluid; thermally communicating the pressure vessel with the inlet of the primary cryogenic pump; allowing the fluid within the pressure vessel to achieve temperature equilibrium with the cryogenic liquid supplied to the primary cryogenic pump; determining the vapor pressure of the cryogenic fluid within the pressure vessel; differentially measuring total pressure and vapor pressure in a differential pressure gauge; and applying pressure to the cryogenic liquid supplied to the inlet of the primary cryogenic pump to maintain total pressure on the cryogenic liquid in excess of the vapor pressure in the pressure vessel by a predetermined magnitude at least equal to a minimum net positive suction head characteristic of the primary cryogenic pump.

More generally the invention includes a method for pumping a cryogenic liquid from a storage tank through a primary cryogenic pump. The primary cryogenic pump and storage tank are coupled by a supply line and a return line wherein any excess cryogenic fluid supplied to the primary cryogenic pump is returned to the storage tank. The method comprises the steps of supplying the cryogenic liquid to the primary pump from the storage tank at a first pressure through a cryogenic booster pump; and adjusting the first pressure of the cryogenic liquid supplied to the primary cryogenic pump to minimize the amount of cryogenic liquid returned through the return line from the primary cryogenic pump to the storage tank.

The invention can also be characterized as a method of measuring the net positive suction head of fluid supplied to an input of a pump. The method comprises the steps of precharging a pressure vessel with a fluid, thermally communicating the pressure vessel with fluid supplied to the inlet of the pump to establish thermal equilibrium, communicating vapor pressure from the pressure vessel to one input of a differential pressure gauge, communicating total pressure from the inlet of the pump to another input of the differential pressure gauge, and balancing the vapor pressure and total pressure against each other in the differential pressure gauge to directly measure the net positive suction head.

The invention further includes an apparatus for pumping cryogenic liquid comprising a cryogenic storage tank, and a primary cryogenic pump having an inlet, outlet and recirculation port. The inlet of the primary cryogenic pump communicates with the storage tank. The primary cryogenic pump is characterized by a requirement for a minimum net positive suction head at the inlet. A first mechanism for measuring the vapor pressure of the cryogenic liquid is in thermal communication with the inlet of the primary cryogenic pump. A second mechanism for measuring the net positive suction head of the cryogenic liquid is in communication with the inlet of the primary cryogenic pump. A third mechanism provides a selected pressure on the cryogenic liquid provided to the inlet of the primary cryogenic pump. The pressure provided by the third mechanism on the cryogenic liquid selectively maintains the difference between the total pressure and vapor pressure at a predetermined magnitude at least equal to the minimum net positive suction head needed by the primary cryogenic pump. A return line is provided for returning excess cryogenic liquid supplied to the inlet of the primary cryogenic pump to the storage tank. By this combination of elements energy absorption by the cryogenic liquid within the apparatus from the environment is minimized, and the duration of operation of the apparatus is maximized.

The first mechanism for measuring the vapor pressure comprises a precharged pressure vessel. The precharged pressure vessel is in thermal communication with the inlet of the primary cryogenic pump, and is in pneumatic communication with the second mechanism for net positive suction head within the pressure vessel. When the precharged gas within the pressure vessel achieves substantial thermal equilibrium with the cryogenic liquid provided to the inlet of the primary cryogenic pump, the second mechanism indicates the net positive suction head at the inlet of the primary cryogenic pump.

The third mechanism comprises a cryogenic booster pump having an inlet coupled to the storage tank and an outlet coupled to the inlet of the primary cryogenic pump. The cryogenic booster pump has a selectively controlled output pressure.

More particularly, the invention includes an apparatus for extended cryogenic pumping comprising a cryogenic storage tank, and a primary cryogenic pump communicating with the cryogenic storage tank. The primary cryogenic pump is characterized by a requirement for a minimum net positive suction head at an inlet of the primary cryogenic pump. A first mechanism senses the vapor pressure of cryogenic liquid supplied from the storage tank to the inlet of the primary cryogenic pump. A second mechanism selectively varies the pressure applied to the cryogenic liquid at the inlet of the primary cryogenic pump to maintain total pressure at the inlet of the cryogenic pump equal to the minimum net positive suction head and current magnitude of the vapor pressure of the cryogenic liquid. A return line from the primary cryogenic pump to the storage tank returns any excess cryogenic liquid supplied to the inlet of the primary cryogenic pump.

More generally, the invention can be characterized as an improvement for pumping a cryogenic liquid including a cryogenic storage tank, a primary cryogenic pump, and a supply line and return line coupling the cryogenic liquid between the tank and primary cryogenic pump. The improvement in the apparatus comprises a first mechanism for sensing vapor pressure of the cryogenic liquid supplied from the storage tank to the pump through the supply line, and a second mechanism for selectively applying pressure to the cryogenic liquid supplied to the primary cryogenic pump in response to vapor pressure sensed by the first mechanism. The second mechanism selectively applies pressure to the cryogenic liquid to maintain the total pressure of the cryogenic liquid which is provided to the primary cryogenic pump at a predetermined magnitude above the sensed vapor pressure. The predetermined magnitude at least or just equals a minimal net positive suction head characteristic of the primary cryogenic pump.

Turn now to the following drawings wherein like elements are referenced by like numerals.

BRIEF DESCRIPTION OF THE DRAWINGS

FIG. 1 is diagrammatic illustration of a portion of a cryogenic pumping system incorporating the invention.

FIG. 2 is a diagrammatic illustration of a portion of a cryogenic system incorporating a second embodiment of the invention.

The invention and its various embodiments are better understood by now turning to the following detailed description.

DETAILED DESCRIPTION OF THE PREFERRED EMBODIMENTS

The invention is a method of reducing the amount of energy absorbed by a recirculated cryogenic liquid to thereby extend the duration of a cryogenic pumping system. The energy absorbed by the recirculated portion of the cryogenic liquid is minimized by minimizing the amount of liquid recirculated. The amount of liquid being recirculated is minimized by supplying a predetermined net positive suction head to the input of a primary cryogenic pump equal in magnitude to approximately just that amount of net positive pressure required to permit the pump to operate or efficiently operate. The appropriate net positive suction head is supplied to the intake of the primary cryogenic pump by feeding the intake of the primary cryogenic pump from a booster pump with an adjustable output. The adjustable output of the booster pump is selected to exceed the current vapor pressure of the cryogenic liquid supplied to the primary cryogenic pump by just that amount necessary to satisfy the net positive suction head specifications of the primary cryogenic pump. The vapor pressure at the intake to the cryogenic pump is directly measured in a sealed pressure vessel. In addition the total pressure at the inlet of the primary cryogenic pump is also measured. The directly measured vapor pressure and directly measured total pressure are then subtracted from each other to obtain the measured net positive suction head actually being applied to the primary cryogenic pump. The output of the booster pump is then adjusted to cause the measured net positive suction head on the intake of the primary cryogenic pump to assume that predetermined magnitude required or specified for the primary pump.

The invention further comprises the apparatus for effectuating the foregoing methodology. The invention and its various embodiments can now be better understood by turning to the diagrammatic illustration of FIG. 1.

A conventional cryogenic storage tank, generally denoted by reference numeral 10, is filled with a cryogenic fluid 12. In the illustrated embodiment, cryogenic fluid 12 is liquid nitrogen although it is contemplated that any cryogenic fluid may be equivalently substituted such as liquid air, liquid oxygen, liquid helium, liquid hydrogen or any other liquified cryogenic gases, compounds, or refrigerants. Initially tank 10 is vented to atmosphere through a valved port 14 and then sealed off. Liquid 12 is drawn from tank 10 through a supply line 16 which is typically noninsulated metallic tubing open to ambient temperatures. Supply line 16 is coupled to intake 18 of a centrifugal booster pump 20. In the illustrated embodiment booster pump 20 is a conventional hydraulically driven centrifugal pump with a variable output pressure and flow rate controlled by a governor 22. It is entirely within the scope of the invention that other types of pumps may be substituted for centrifugal booster pump 20 including noncentrifugal, or electrically or mechanically driven pumps.

Output 24 of booster pump 20 is coupled through line 26 to intake 28 of a triplex reciprocating cryogenic pump 30. Outlet 32 of triplex pump 30 is then coupled to the subject system to provide liquid nitrogen under pressure. Again, in the illustrated embodiment the subject application is contemplated as including the vaporization of nitrogen for well service operations. However, the invention is not limited to the particular application of the pumped cryogenic fluid 12, but is directed generally to pumping systems for cryogenic liquids.

A return line 34 is coupled between primary pump 30 and storage tank 10. Therefore, any excess cryogenic liquid 12 delivered to intake 28 of primary pump 30, which is not pumped to outlet 32, is diverted to recirculation line 34 and ultimately to storage tank 10. Lines 16, 26 and 34 are generally made of metallic tubing open to the ambient environment as is conventional practice. However, this does not preclude the possibility that one or more of these lines may be insulated by any means now known or later devised. However, in the illustrated embodiment for reasons of practical durability and economics, conventional metallic tubing is utilized.

Line 26 is also coupled to or pneumatically communicated with a conventional differential pressure gauge 36. Pressure gauge 36 measures the total pressure at the output of booster pump 20 or equivalently at the input 28 of primary pump 30. Pressure vessel 38 is thermally communicated with the cryogenic fluid within line 26. In the illustrated embodiment, pressure vessel is disposed in line 26 or more precisely in the inlet manifold of pump 30. Pressure vessel 38 is also pneumatically coupled to or in communication with conventional differential pressure gauge 36 which, as described below, will indicate the net positive suction head of cryogenic liquid 12 at input 28 of primary pump 30.

When the system illustrated in FIG. 1 is about to be run, pressure vessel 38 is precharged with gas of the same type as cryogenic liquid 12. In the illustrated embodiment pressure vessel 38 is precharged through an inlet valve 46 with gaseous nitrogen at 200 psi. Storage tank 10 may also be precharged, generally with approximately 35 psi. Since storage tank 10 is vented just prior to operation the effective vapor pressure within storage tank 10 at the beginning of operation is near zero (gauge) or ambient in absolute pressure. Cryogenic liquid is an excellent insulator and therefore only a thin layer on the top of liquid 12 within storage tank 10 is warmed by the air above liquid 12. The remaining cryogenic liquid 12 beneath the surface layer is at an initial temperature assumed by liquid 12 when it is first disposed within tank 10. Storage tank 10 is pressurized by a nominal pressure, nearly all of which will initially appear as the net positive suction head at intake 18 of booster pump 20, since the vapor pressure is nil to begin with. Booster pump 20 begins operation and starts to pump liquid nitrogen through lines 16, 26 and 34. The gaseous nitrogen within pressure vessel 38 begins to be cooled by the liquid nitrogen within line 26. Ultimately the nitrogen within pressure vessel 38 will come to a temperature equilibrium with the nitrogen within line 26. Gaseous nitrogen within pressure vessel 38 will be cooled and liquified, thereby dropping the pressure. Thus, the pressure within pressure vessel 38 will ultimately assume a value as dictated by the temperature of the nitrogen within vessel 38 and hence ultimately the temperature of nitrogen flowing through line 26. At equilibrium or near equilibrium, the pressure shown at pressure vessel 38 will thus be the vapor pressure, Pv, while the pressure shown at the outlet 24 of booster pump 20 will show the total pressure, Pt, at inlet 28 of primary pump 30. The total pressure at inlet 28 of primary pump 30 is equal to the vapor pressure of the liquid nitrogen being supplied to inlet 28 and the positive pressure applied thereto by booster pump 20. The difference between the total pressure and the vapor pressure is the net positive suction head applied to inlet 28 of primary pump 30. By applying the vapor pressure, Pv, from pressure vessel 38 through capillary tube 40 to one side of differential pressure gauge 36 and by applying the total pressure, Pt, from line 26 through capillary tube 44 to the other side of differential pressure gauge 36, the net positive suction head pressure can be directly measured. A minimum net positive suction head pressure for primary pump 30 is known and specified according to the design of pump 30. In the illustrated embodiment the conventional triplex reciprocating pump used as primary pump 30 requires a minimum of approximately 25 psi in order to operate efficiently. Therefore, the operator observes the net pressure suction head, and manually adjusts governor 22 until the output of booster pump 20 is increased or decreased to provide the required net positive suction head for primary pump 30.

By maintaining the net positive suction head at a magnitude which is just equal to or slightly exceeds the minimum predetermined head required by primary pump 30, the amount of excess liquid nitrogen pumped through lines 16 and 26 and back through recirculating line 34 to storage tank 10 is minimized. The lower the amount of liquid nitrogen recirculated between primary pump 30 and storage tank 10, the less the amount of energy that will be absorbed from the environment into the liquid nitrogen. As a result the operating time of the system can be dramatically and substantially increased. For example, where at minimum output such a system could be run at best for 40 hours before cavitation occurred at input 18 of booster pump 20, the present invention allows the same system to be run at the same output for several hundred hours or more.

Turn now to FIG. 2 wherein a second embodiment of the invention is illustrated. The embodiment of FIG. 1 depicted a methodology and apparatus wherein a manual adjustment was made to governor 22 to obtain the net pressure suction head of primary pump 30. The embodiment of FIG. 2 diagrammatically illustrates a system which is automatically selfadjusting.

In FIG. 2 pressure gauge 36 has been deleted and pressure transducers 100 and 102 have been substituted therefor. Transducers 100 and 102 convert the pressure sensed in line 26 and pressure vessel 38 respectively into a corresponding analog electrical signal. The electrical signal is then converted by conventional a-to-d converters 104 and 106 respectively. The output of a-to-d converters 104 and 106 are then subtracted in an adder or arithmetic logical unit 108. The difference of the output of transducers 100 and 102 is the measured net positive suction head at inlet 28 of primary pump 30. The difference signal is coupled to input 110 of comparator 112. The other input 114 of comparator 112 is coupled to a reference voltage or signal indicative of the predetermined net positive suction head required by primary pump 30. Any difference between these signals is coupled between the output 116 of comparator 112 to the input 118 of a driver circuit 120. Driver circuit 120 senses either a negative or positive difference from output 116 of comparator 112 and generates a corresponding negative or positive driving signal which is used to power an electromechanical actuator 122. Actuator 122 in turn is mechanically coupled to governor 22 which controls the speed of booster pump 20 and thus its output pressure.

Alternatively, in FIG. 1 a transducer could be appropriately coupled to differential pressure gauge 36 and an analog or digital difference signal corresponding to the directly measured net positive suction head could be used to generate an appropriate feedback signal to governor 22 or pump 20.

Therefore, the invention as embodied in the illustration of FIG. 2 contemplates a system for automatically maintaining the net positive suction head to the intake 28 of primary pump 30 at just that level necessary to allow efficient operation of the pump and thereby to minimize cryogenic liquid 12 which is recirculated through line 34 to tank 10.

Storage tank 10 of course is not a perfectly insulated cryogenic tank and a small amount of energy will be drawn from the environment into cryogenic liquid 12. Similarly, some recirculated cryogenic fluid may be returned on line 34 and hence pick up additional energy for return to storage tank 10. Thus, very slowly the temperature of liquid nitrogen 12 within tank 10 will rise and the vapor pressure of the nitrogen in storage tank 10, as well as throughout the system will increase. However, as the vapor pressure increases, this will be measured through pressure vessel 38 as described above and booster pump 20 is appropriately adjusted to maintain the minimum net positive suction head at intake 28 of primary pump 30. Ultimately, however, the vapor pressure within storage tank 10 will reach equilibrium within tank 10 leaving little if any net positive suction head at intake 18 of booster pump 20.

However, by the automatically adjusting the net positive suction head at intake 28 of primary pump 30 to the minimum necessary, the amount of returning fluid flowing along recirculating line 34 can be reduced to an insignificant fraction of the liquid nitrogen within storage tank 10. Hence, the operable duration of the system then begins to approach the storage lifetime within cryogenic tank 10 itself. As is well known, with an appropriately constructed cryogenic storage tank, storage lifetimes may exceed many weeks if not months. Therefore the effective operation time of the system when incorporating the present invention is extended well beyond any conceivable operation time encountered in the field. In fact, the practical limitation becomes the user's ability to store a sufficient amount of liquid nitrogen to be able to supply the amount which can be pumped in the possible storage lifetime.

In any case, the operational lifetime of the system for a single charge of cryogenic liquid can never be longer than the storage time of the liquid within the cryogenic tank 10. In the extreme even if no fluid were recirculated at all to storage tank 10, cryogenic liquid 12 would ultimately increase in temperature and boil off or exceed the pressure limits of cryogenic tank 10 whether cryogenic liquid was being consumed or not. Therefore, the advantage of the present invention is to extend the operation of any cryogenic system to approach that of the storage lifetime of the cryogenic liquid within the system.

Many modifications or alterations may be made by those having ordinary skill in the art without departing from spirit and scope of the invention. For example, although in FIG. 2 the means for automatically adjusting the output of booster pump 20 to maintain a predetermined minimum net positive suction head on primary pump 30 is shown as a digital electronic circuit, it is also expressly contemplated that an analog circuit could be equivalently exploited. Similarly, the electrical servosystem of FIG. 2 could be replaced by an equivalent pneumatic servosystem.

Therefore, the illustrated embodiment has been shown only by way of example and should not be taken as limiting the invention as defined in the following claims.

I claim:

1. A method of pumping cryogenic liquid comprising the steps of:

applying a first pressure to cryogenic liquid to the inlet of a cryogenic pump;

measuring the vapor pressure of said cryogenic liquid at said inlet to said cryogenic pump;

measuring total pressure of said cryogenic liquid at said inlet of said pump;

differencing said vapor pressure from said total pressure to obtain a measured net positive suction head at said inlet of said pump;

adjusting said first pressure until said measured net positive suction head at least equals a predetermined magnitude corresponding to a predetermined minimum net pressure suction head characteristic of said pump; and returning excess cryogenic liquid from said inlet of said cryogenic pump to said storage tank, whereby the duration of operation of said cryogenic pump is extended.

2. The method of claim 1 where said step of applying pressure to said cryogenic liquid at the inlet of said cryogenic pump comprises the steps of:

drawing cryogenic liquid from a storage tank into a variably controllable booster pump; and transferring cryogenic liquid from the output of said booster pump to said inlet of said cryogenic pump; and where said step of adjusting said first pressure comprises the step of:

selectively adjusting the output of said booster pump until said measured net positive suction head equals said predetermined magnitude corresponding to said cryogenic pump.

3. The method of claim 1 where said step of measuring said vapor pressure comprises the step of:

directly pneumatically communicating said vapor pressure of said cryogenic liquid to a differential pressure gauge having a first and second input, said first input communicating with said vapor pressure, and where said step of measuring said total pressure comprises the step of:

balancing said vapor pressure against said total pressure in said differential pressure gauge.

4. The method of claim 3 where said step of directly measuring said vapor pressure comprises the steps of:

precharging a pressure vessel with a gas, said pressure vessel in thermal communication with said inlet of said cryogenic pump;

allowing said gas disposed into said pressure vessel to reach thermal equilibrium with said cryogenic liquid provided to said inlet of said cryogenic pump; and measuring the vapor pressure of said gas in said pressure vessel after equilibrium is substantially achieved.

5. The method of claim 4 where said step of measuring said vapor pressure in said pressure vessel comprises the steps of:

generating a vapor pressure signal indicative of the actual vapor pressure within said pressure vessel, where said step of measuring said total pressure comprises the step of:

generating a total pressure signal indicative of the actual total pressure at said inlet of said cryogenic pump, where said step of differencing said vapor pressure from said total pressure comprises the step of:

subtracting said vapor pressure signal from said total pressure signal within a differencing means for computing differences to generate a difference signal, and where said step of adjusting said first pressure comprises the steps of:

comparing said difference signal generated by said differencing means to a reference signal corresponding to said predetermined magnitude;

generating a comparison signal indicative of the comparative relationship of said difference signal to said reference signal;

generating a feedback driving signal in response to said comparison signal, said feedback driving signal being applied to booster pump means for providing said first pressure to said inlet of said cryogenic pump, said feedback drive signal adjusting the output of said booster pump means to ultimately cause said difference signal to approach the magnitude of said reference signal

6. An apparatus for pumping cryogenic liquid comprising:

a cryogenic storage tank;

a primary cryogenic pump having an inlet, outlet and recirculation port, said inlet of said primary cryogenic pump communicating with said storage tank, said primary cryogenic pump characterized by the requirement of a minimum net positive suction head at said inlet;

first means for measuring the vapor pressure of said cryogenic liquid, said first means being in thermal communication with said inlet of said primary cryogenic pump and said first means for measuring the total pressure of said cryogenic liquid in communication with said inlet of said primary cryogenic pump;

second means for providing a selected pressure on said cryogenic liquid provided to said inlet of said primary cryogenic pump, said pressure provided by said second means on said cryogenic liquid selectively maintaining the difference between said total pressure and vapor pressure at a predetermined magnitude at least equal to the minimum net positive suction head of said primary cryogenic pump; and a return line for returning excess cryogenic liquid supplied to said inlet of said primary cryogenic pump to said storage tank, whereby energy absorption by said cryogenic liquid within said apparatus from the environment is minimized, and whereby the duration of operation of said apparatus is maximized.

7. The apparatus of claim 6 wherein said first means for measuring said vapor pressure comprises:

a precharged pressure vessel in thermal communication and equilibrium with said cryogenic liquid;

means for measuring pressure within said pressure vessel when said precharged gas within said pressure vessel establishes substantial temperature equilibrium with said cryogenic liquid provided to said inlet of said primary cryogenic pump; and a capillary line communicating said precharged pressure vessel to said means for measuring.

8. The apparatus of claim 7 wherein said second means comprises a cryogenic booster pump having an inlet coupled to said storage tank and an outlet coupled to said inlet of said primary cryogenic pump, said cryogenic booster pump having a selectively controlled output pressure.

9. The apparatus of claim 7 wherein said first means for measuring said vapor pressure further comprises transducer means for generating a vapor pressure signal;

wherein said second means for measuring said total pressure comprises transducer means for generating a total pressure signal; and wherein said second means further comprises signal processing means for differencing said total pressure signal and said vapor pressure signal to derive a difference signal, for comparing said difference signal to a reference signal corresponding to said minimal net positive suction head to derive a comparison signal, and for generating a feedback signal to selectively adjust said output pressure of said booster pump means to maintain said reference signal and difference signal substantially equal.

10. The apparatus of claim 6 wherein said second means comprises a cryogenic booster pump having an inlet coupled to said storage tank and an outlet coupled to said inlet of said primary cryogenic pump, said cryogenic booster pump having a selectively controlled output pressure.

11. An apparatus for extended cryogenic pumping comprising:

a cryogenic storage tank;

a primary cryogenic pump communicating with said cryogenic storage tank, said primary cryogenic pump characterized by a minimum net positive suction head at an inlet of said primary cryogenic pump;

first means for sensing the net positive suction head of cryogenic liquid supplied from said storage tank to said inlet of said primary cryogenic pump; and second means for selectively varying pressure applied to said cryogenic liquid at said inlet of said primary cryogenic pump to maintain total pressure at said inlet of said cryogenic pump equal to said minimum net positive suction head and current magnitude of the vapor pressure of said cryogenic liquid; and a return line from said primary cryogenic pump to said storage tank for returning excess cryogenic liquid supplied to said inlet of said primary cryogenic pump, whereby duration of operation of said apparatus on a single charge of cryogenic liquid is extended.

12. The apparatus of claim 11 wherein said first means comprises:

a pressure vessel precharged with the same type of fluid as said cryogenic liquid within said storage tank;

differential pressure gauge means for measuring vapor pressure within said pressure vessel and for measuring total pressure;

a first capillary tube coupling said pressure vessel with said gauge means; and a second tube coupling said inlet of said primary cryogenic pump with said gauge means.

13. The apparatus of claim 12 wherein said second means comprises:

a booster pump means for providing a controllable variable output pressure to said cryogenic liquid provided to said inlet of said primary cryogenic pump; and control means coupled to said total pressure gauge means and vapor pressure gauge means, said control means for generating a feedback control signal coupled to said booster pump means, said booster pump means providing said variable pressure in response to said control signal, said control means generating said control signal to maintain the difference between said vapor pressure signal and total pressure signal equal to said minimum net positive suction head characterizing said primary cryogenic pump.

14. An improvement in an apparatus for pumping a cryogenic liquid including a cryogenic storage tank, a primary cryogenic pump, and a supply line and return line coupling said cryogenic liquid between said tank and primary cryogenic pump, said improvement comprising:

first means for sensing net positive suction pressure of said cryogenic liquid supplied from said storage tank to said pump through said supply line; and second means for selectively applying pressure to said cryogenic liquid supplied to said primary cryogenic pump in response to net positive suction pressure sensed by said first means, said second means selectively applying pressure to said cryogenic liquid to maintain total pressure of said cryogenic liquid provided to said primary cryogenic pump at a predetermined magnitude above the vapor pressure, said predetermined magnitude at least equalling a minimal net positive suction head characteristic of said primary cryogenic pump, whereby cryogenic liquid returned through said return line form said primary cryogenic pump to said cryogenic storage tank is minimized and whereby duration of operation of said apparatus is extended.

15. The apparatus of claim 14 wherein said first means comprises:

a pressure vessel precharged with a fluid, said pressure vessel in thermal communication with said cryogenic liquid;

means for indicating net positive suction pressure of said cryogenic liquid supplied to said primary cryogenic pump; and a capillary tube communicating said pressure vessel with said means for indicating net positive suction pressure.

16. A method of pumping cryogenic liquid from a storage tank to a primary cryogenic pump wherein said storage tank and cryogenic pump are coupled through a supply line and a return line for returning excess cryogenic liquid supplied to said pump to said storage tank, said method comprising the steps of:

precharging a pressure vessel with a cryogenic fluid;

thermally communicating said pressure vessel to said inlet of said primary cryogenic pump to establish a vapor pressure within said pressure vessel;

allowing said cryogenic fluid within said pressure vessel to achieve temperature equilibrium with said cryogenic liquid supplied to said primary cryogenic pump;

determining the net positive suction head of said cryogenic fluid within said pressure vessel; and applying pressure to said cryogenic liquid supplied to said inlet of said primary cryogenic pump to maintain total pressure on said cryogenic liquid in excess of said vapor pressure in said pressure vessel by a predetermined magnitude at least equal to a minimum net positive suction head characteristic of said primary cryogenic pump, whereby the maximum duration of cryogenic pumping is extended.

17. A method for pumping a cryogenic liquid from a storage tank through a primary cryogenic pump, said primary cryogenic pump and storage tank coupled by a supply line and a return line wherein excess cryogenic fluid supplied to said primary cryogenic pump is returned to said storage tank, said method comprising the steps of:

supplying said cryogenic liquid to said primary pump from said storage tank at a first pressure through a cryogenic booster pump; and adjusting said first pressure of said cryogenic liquid supplied to said primary cryogenic pump to minimize the amount of cryogenic liquid returned through said return line from said primary cryogenic pump to said storage tank, whereby recirculation of said cryogenic liquid is minimized and absorption of energy from the environment minimized to extend the duration of operation.

18. The method of claim 17 where said step of adjusting said pressure comprises the steps of:

directly measuring the net positive suction head of said cryogenic liquid supplied to said primary cryogenic pump; and applying additional pressure to said cryogenic liquid by said cryogenic booster pump to maintain the net positive suction head on said cryogenic liquid at said primary cryogenic pump at least equal to the minimum net positive suction head required by said primary cryogenic pump.

19. The method of claim 18 where said step of directly measuring said vapor pressure comprises the steps of:

thermally communicating said cryogenic liquid with a pressure vessel precharged with a cryogenic fluid;

allowing said cryogenic fluid in said pressure vessel to achieve temperature equilibrium with said cryogenic liquid supplied to said primary cryogenic pump; and determining the net positive suction head of said cryogenic fluid in said pressure vessel.

20. A method of measuring the net positive suction head of fluid supplied to an input of a pump comprising the steps of:

precharging a pressure vessel with a fluid;

thermally communicating said pressure vessel with fluid supplied to said inlet of said pump to establish thermal equilibrium;

communicating vapor pressure from said pressure vessel to one input of a differential pressure gauge;

communicating total pressure from said inlet of said pump to another input of said differential pressure gauge; and balancing said vapor pressure and total pressure against each other in said differential pressure gauge to directly measure said net positive suction head.

* * * * *